US010822739B2

(12) United States Patent
Lim et al.

(10) Patent No.: US 10,822,739 B2
(45) Date of Patent: Nov. 3, 2020

(54) INDUCTION DRYER APPLIANCE WITH A BEARING SYSTEM

(71) Applicant: Haier US Appliance Solutions, Inc., Wilmington, DE (US)

(72) Inventors: Tae-Hoon Lim, Seongnam-Si (KR); Geon Ho Kim, Seongnam-Si (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 208 days.

(21) Appl. No.: 16/032,169

(22) Filed: Jul. 11, 2018

(65) Prior Publication Data

US 2020/0018013 A1 Jan. 16, 2020

(51) Int. Cl.

| | |
|---|---|
| ***D06F 58/26*** | (2006.01) |
| ***D06F 58/06*** | (2006.01) |
| ***D06F 58/10*** | (2006.01) |
| ***D06F 58/18*** | (2006.01) |
| ***D06F 58/30*** | (2020.01) |
| ***D06F 39/12*** | (2006.01) |
| ***D06F 34/28*** | (2020.01) |
| ***D06F 105/28*** | (2020.01) |

(52) U.S. Cl.

CPC ..... *D06F 58/26* (2013.01); *D06F 58/06* (2013.01); *D06F 58/10* (2013.01); *D06F 58/18* (2013.01); *D06F 58/30* (2020.02); *D06F 34/28* (2020.02); *D06F 39/12* (2013.01); *D06F 2105/28* (2020.02)

(58) Field of Classification Search

CPC ..... D06F 58/26; D06F 58/30; D06F 58/18; D06F 58/10; D06F 58/06; D06F 2105/28; D06F 34/28; D06F 39/12

See application file for complete search history.

(56) References Cited

U.S. PATENT DOCUMENTS

| | | | | |
|---|---|---|---|---|
| 3,040,440 A * | 6/1962 | Mellinger | ..... | D06F 25/00 34/75 |
| 4,181,846 A | 1/1980 | Cunningham | | |
| 5,724,750 A * | 3/1998 | Burress | ..... | D06F 5/02 34/267 |

(Continued)

FOREIGN PATENT DOCUMENTS

| | | |
|---|---|---|
| CN | 101701417 | 5/2010 |
| CN | 102191675 | 9/2011 |

(Continued)

OTHER PUBLICATIONS

International Search Report, PCT Application No. PCT/CN2019/095538, dated Oct. 16, 2019, 3 pages.

*Primary Examiner* — Jessica Yuen

(74) *Attorney, Agent, or Firm* — Dority & Manning, P.A.

(57) ABSTRACT

An induction dryer appliance includes a cabinet. A drum is positioned within the cabinet. The drum is rotatable about an axis within the cabinet. The induction dryer appliance also includes an induction heating element and a support assembly. The support assembly is positioned within the cabinet adjacent the drum. The support assembly includes a plate. The induction heating element is positioned on the plate. A bearing is mounted to the plate. The bearing contacts the drum as the drum rotates about the axis such that the bearing spaces the plate from the drum along a radial direction that is perpendicular to the axis.

17 Claims, 3 Drawing Sheets

(56) References Cited

U.S. PATENT DOCUMENTS

| | | | | |
|---|---|---|---|---|
| 2009/0100697 | A1* | 4/2009 | Steffens | D06F 58/22<br>34/82 |
| 2018/0057996 | A1 | 3/2018 | Park et al. | |
| 2018/0148886 | A1* | 5/2018 | Kalze | D06F 58/30 |

FOREIGN PATENT DOCUMENTS

| | | | |
|---|---|---|---|
| EP | 3246457 | | 11/2017 |
| EP | 3246457 | A1 | 11/2017 |
| JP | S6158694 | | 3/1986 |
| JP | 2009050684 | A | 3/2009 |
| KR | 100922986 | | 10/2009 |
| KR | 100922986 | B1 * | 10/2009 |

* cited by examiner

INDUCTION DRYER APPLIANCE WITH A BEARING SYSTEM

FIELD OF THE INVENTION

The present subject matter relates generally to induction dryer appliances.

BACKGROUND OF THE INVENTION

Dryer appliances generally include a cabinet with a drum rotatably mounted therein. During operation, a motor rotates the drum, e.g., to tumble articles located within a chamber in the drum. Dryer appliances also generally include a heater assembly that passes heated air through the chamber in order to dry moisture-laden articles within the drum chamber. Typically, an air handler is used to urge the flow of heated air from chamber, through a trap duct, and to the exhaust duct where it is exhausted from the dryer appliance. Dryer appliances may further include filter systems for removing foreign materials, such as lint, from passing into the exhaust conduit, which can impair dryer performance and may present a hazard due to the potential for combustion.

Conventional heater assemblies include electrical resistance heaters, such as wire coils, that generate heat when electrical current is passed through them. Notably, these resistance heaters are typically only 70%-80% efficient, resulting in significant wasted energy during operation. In addition, known dryer appliances include two resistance heater coils which are connected to three-phase power systems to energize these heaters in one of three steps—OFF for no heat, one heater ON for low heat, or two heaters ON for high heat. Therefore, the temperature within the drum may not be controlled linearly, resulting in significant operating restrictions and limited versatility in terms of using different operating cycles to dry various load types.

BRIEF DESCRIPTION OF THE INVENTION

Aspects and advantages of the invention will be set forth in part in the following description, or may be apparent from the description, or may be learned through practice of the invention.

In a first example embodiment, an induction dryer appliance includes a cabinet. A drum is positioned within the cabinet. The drum is rotatable about an axis within the cabinet. The induction dryer appliance also includes an induction heating element and a support assembly. The support assembly is positioned within the cabinet adjacent the drum. The support assembly includes a plate. The induction heating element is positioned on the plate. A bearing is mounted to the plate. The bearing contacts the drum as the drum rotates about the axis such that the bearing spaces the plate from the drum along a radial direction that is perpendicular to the axis.

In a second example embodiment, an induction dryer appliance includes a cabinet. A drum is positioned within the cabinet. The drum is rotatable about an axis within the cabinet. The induction dryer appliance also includes a pair of induction heating elements. A pair of support assemblies is positioned within the cabinet adjacent the drum. Each support assembly of the pair of support assemblies includes a plate and a bearing. Each induction heating element of the pair of induction heating elements is positioned on a respective plate of the pair of support assemblies. Each bearing is mounted to a respective plate of the pair of support assemblies. Each bearing contacts the drum as the drum rotates about the axis in order to space the respective plate from the drum along a radial direction that is perpendicular to the axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
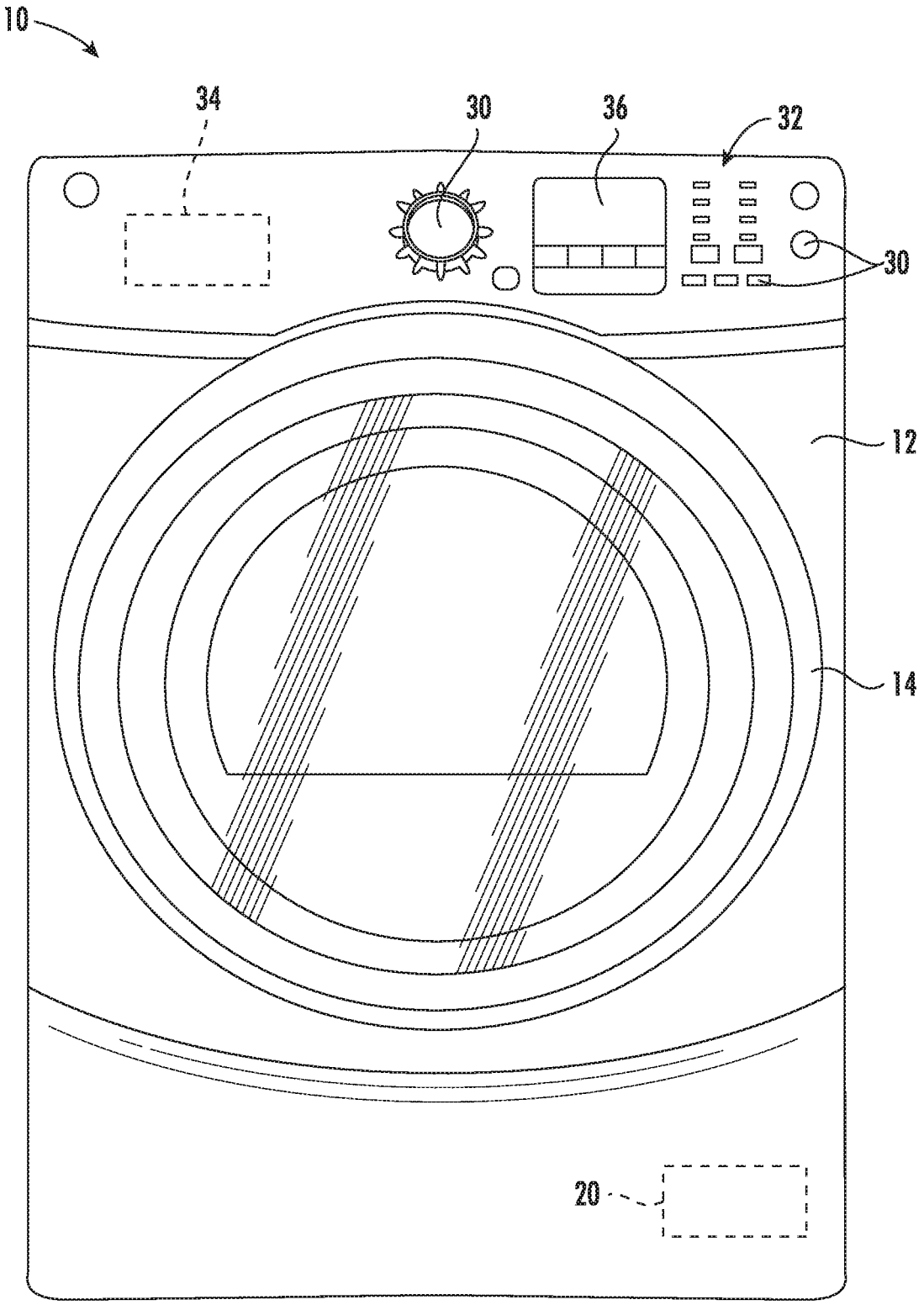
FIG. 1 is a front elevation view of a dryer appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
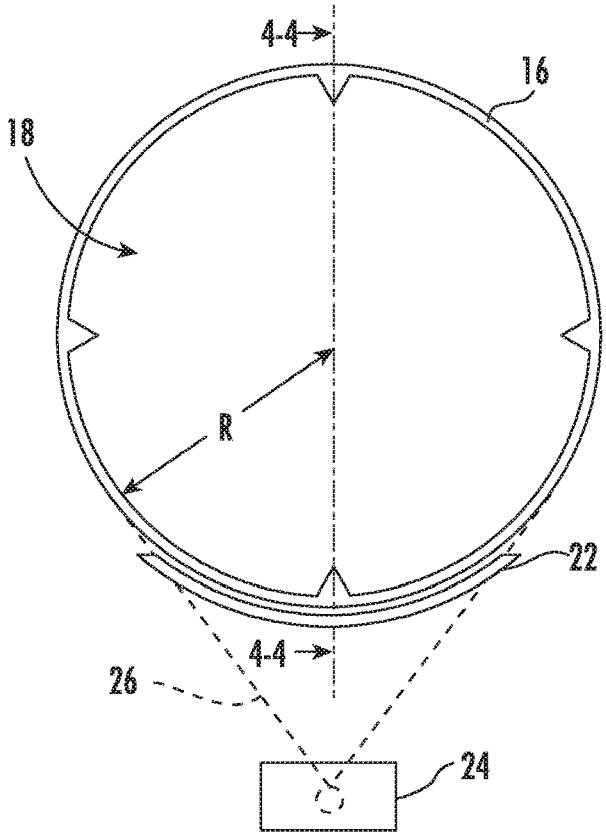
FIG. 2 is a front section view of a drum and an induction heater of the example dryer appliance of FIG. 1.
Figure 3:
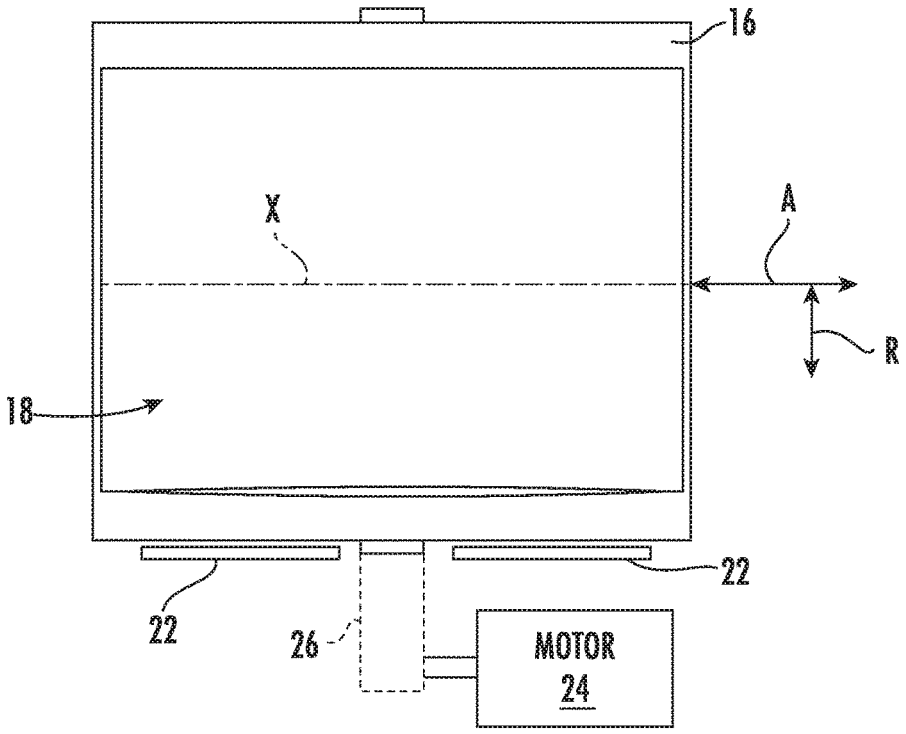
FIG. 3 is a side section view of the drum and the induction heater of the example dryer appliance of FIG. 1.

FIG. 1 illustrates a dryer appliance 10 according to an exemplary embodiment of the present subject matter. FIGS. 2 and 3 are schematic views of various components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well.

With reference to FIGS. 1 through 3, dryer appliance 10 includes a cabinet 12 with a door 14. Within cabinet 12 is a container or drum 16 which defines a chamber 18 for receipt of articles, e.g., clothing, linen, etc., for drying. Drum 16 is rotatable, e.g., about an axis X, within cabinet 12. In particular, a motor 24 is coupled to drum 16 such that motor 24 is operable to rotate drum 16 about the axis X. A belt 26 may couple motor 24 to drum 16 such that motor 24 is operable to rotate drum 16. Door 14 is rotatably mounted to cabinet 12 for providing selective access to drum 16.

An air handler 20, such as a blower or fan, may be provided to generate airflow through chamber 18. Thus, air handler 20 is configured for drawing a flow of air through chamber 18 of drum 16, e.g., in order to dry articles located therein. Dryer appliance 10 may include induction heating elements 22 for heating the air and/or articles within chamber 18, as discussed in greater detail below. Heat facilitates drying of damp articles disposed within chamber 18 of drum 16.

As discussed above, during operation of dryer appliance 10, motor 24 operates to rotate drum 16 via belt 26. In addition, air handler 20 operates to generate airflow through chamber 18 of drum 16. In particular, air handler 20 may urge ambient air into chamber 18 of drum 16. Within chamber 18, the ambient air is heated by induction heating elements 22, and the heated air removes moisture, e.g., from damp articles disposed within chamber 18. The moisture laden heated air then flows from chamber 18 and is exhausted from cabinet 12. A filter (not shown), which includes a screen filter or other suitable device for removing lint and other particulates, may be provided to filter the moisture laden heated air exiting chamber 18. After the clothing articles have been dried (or a drying cycle is otherwise completed), the clothing articles are removed from drum 16, e.g., by accessing chamber 18 by opening door 14.

One or more selector inputs 30, such as knobs, buttons, touchscreen interfaces, etc., may be provided on a control panel 32 of cabinet 12 and may be in communication with a processing device or controller 34. Signals generated in controller 34 operate air handler 20, induction heating elements 22, motor 24 and other dryer appliance components in response to actuation of selector inputs 30. Additionally, a display 36, such as an indicator light or a screen, may be provided on control panel 32. Display 36 may be in communication with controller 34, and may display information in response to signals from controller 34.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

Induction heating elements 22 generally includes an induction coil, such as a litz wire coil, positioned in proximity to drum 16. The induction coil is generally configured for generating an electromagnetic field when supplied with a high-frequency alternating current. In addition, drum 16 is constructed of or with a ferromagnetic material, such as iron, an iron alloy, or any other suitable material that generates heat in the presence of an electromagnetic field. Thus, drum 16 (or a component of drum 16) is configured for generating heat when energized by the electromagnetic field from the induction coil by inducing eddy currents in drum 16.

Controller 34 may be operably coupled to the induction coil of induction heating elements 22 and may be configured for energizing the induction coil as needed for a particular dryer operating cycle. In this regard, for example, controller 34 may be configured for progressively or linearly adjusting the electromagnetic field generated by the induction coil, thereby enabling fine tuning of the heat generated by induction heating elements 22 and the corresponding drum temperature. By contrast, conventional electric resistance heaters have only one or two heating levels.

Figure 4:
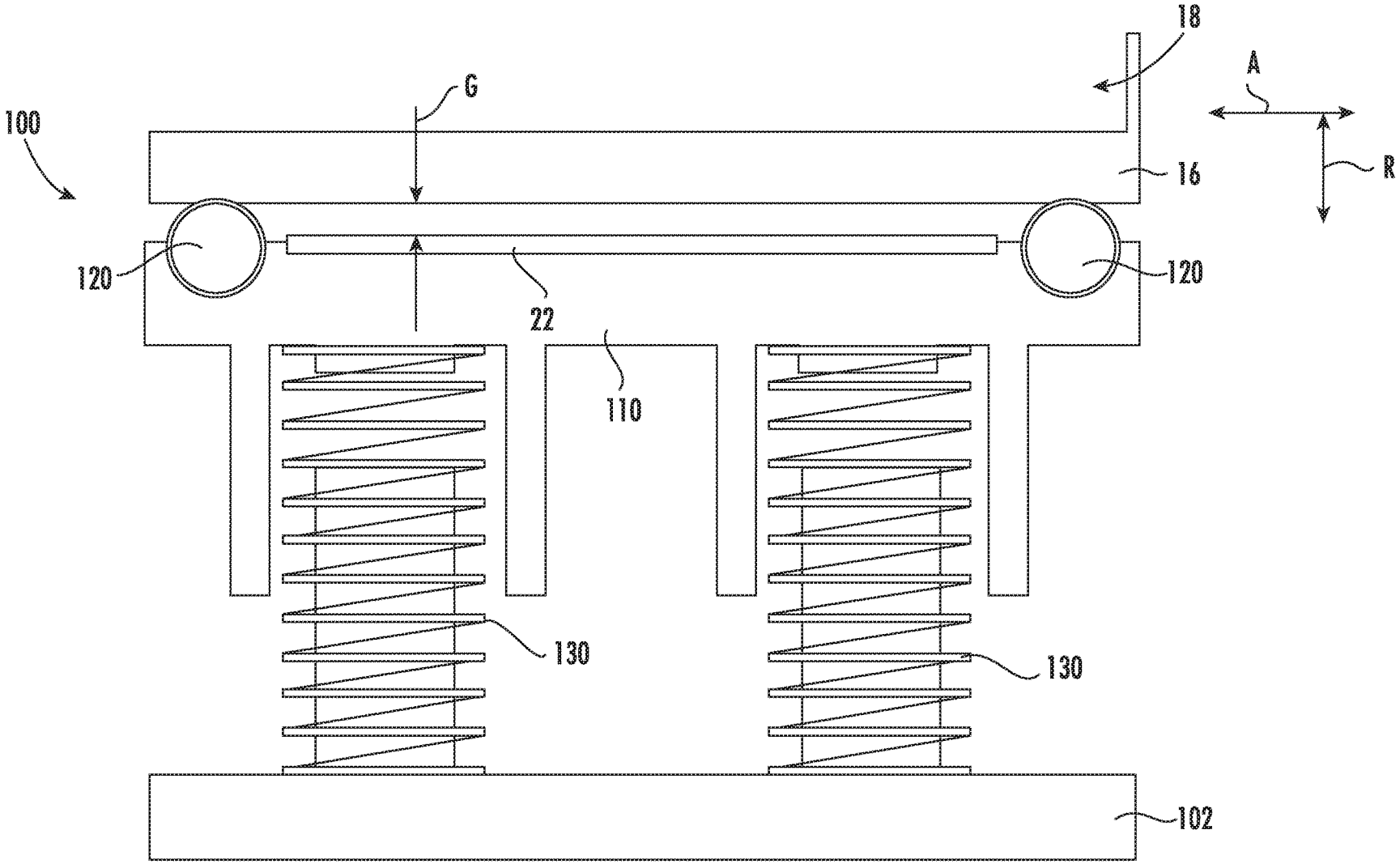
FIG. 4 is a partial, section view of a support assembly of the example dryer appliance of FIG. 1.

FIG. 4 is a partial, section view of a support assembly 100 of dryer appliance 10. Support assembly 100 is configured for positioning one or more of induction heating elements 22 adjacent drum 16. In FIG. 4, only one of induction heating elements 22 is positioned on support assembly 100. Thus, support assembly 100 is described in greater detail below as in the context of supporting one of induction heating elements 22. The other of induction heating elements 22 may be positioned on an additional support assembly, e.g., at an opposite end of drum 16. The additional support assembly may be constructed in the same or similar manner to that shown in FIG. 4. In alternative example embodiments, support assembly 100 may be configured to support both induction heating elements 22.

Support assembly 100 may be positioned within cabinet 12. In particular, support assembly 100 may be positioned directly below drum 16 within cabinet 12. As discussed in greater detail below, support assembly 100 includes features for maintaining a radial gap G between induction heating element 22 and drum 16. Thus, support assembly 100 may facilitate more consistent heating of drum 16 by induction heating element 22.

Support assembly 100 includes a plate 110 and a pair of bearings 120. Induction heating element 22 is positioned on plate 110. For example, induction heating element 22 may be mounted to plate 110, e.g., with fasteners, clamps, etc. As an example, plate 110 may be formed of a molded plastic. Bearings 120 are mounted to plate 110 and contact drum 16. In particular, bearings 120 contact drum 16 as drum 16 rotates about the axis X. Thus, bearings 120 space plate 110 from drum 16 along a radial direction R, e.g., that is perpendicular to the axis X.

Bearings 120 may space plate 110 from drum 16 as drum 16 rotates about the axis X in order to maintain a constant radial gap G. In other words, bearings 120 allow induction heating element 22 to track the motion of drum 16 along the radial direction R. With a constant radial gap G, performance of dryer appliance 10 may be improved compared to fixing induction heating element 22 relative to cabinet 12. In particular, maintaining the constant radial gap G with bearings 120 may allow more accurate and/or precise heating of drum 16 with induction heating element 22. The radial gap G may be defined between an outer surface of drum 16 and an outer surface of induction heating element 22 that face each other along the radial direction R.

Bearings 120 may also be spaced apart along an axial direction A, e.g., that is parallel to the axis X, on plate 110. In particular, induction heating element 22 may be positioned between bearings 120 along the axial direction A on plate 110. Such spacing between bearings 120 and/or the relative position of induction heating element 22 and bearings 120 may assist with reliably positioning induction heating element 22 relative to drum 16. In particular, such spacing between bearings 120 may limit rotation of induction heating element 22 relative to drum 16 on plate 110.

Bearings 120 may be roller bearing, slide bearings, etc. When bearings 120 are roller bearings, bearings 120 may roll on the outer surface of drum 16. Thus, bearings 120 may assist with maintaining the constant radial gap G without significantly increasing the energy required to rotate drum with motor 24.

Support assembly 100 may also include a pair of springs 130. Springs 130 are coupled to plate 110. Springs 130 urge plate 110 towards drum 16, e.g., along the radial direction R.

Springs 130 may urge plate 110 towards drum 16 such that bearings 120 maintain contact with drum 16 as drum 16 rotates about the axis X. For example, the force applied by springs 130 may be oriented towards and/or incident on the axis X. Springs 130 may be coil springs, gas springs, etc. Springs 130 may extend between a base 102 on a floor of cabinet 12 and plate 110 below drum 16.

As may be seen from the above, plate 110 and induction heating element 22 may be biased towards drum 16. Thus, springs 130 may facilitate maintenance of the constant radial gap G between induction heating element 22 and drum 16. Springs 130 may be spaced apart along the axial direction A. For example, each spring 130 may be positioned adjacent a respective one of bearings 120.

In FIG. 4, induction heating element 22 is positioned below drum 16 on plate 110. As noted above, only one of induction heating elements 22 is shown in FIG. 4. The other of induction heating elements 22 may be positioned on drum 12 on the opposite side of belt 26. Thus, belt 26 may be positioned between induction heating elements 22 along the axial direction A.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An induction dryer appliance, comprising:
- a cabinet;
- a drum positioned within the cabinet, the drum rotatable about an axis within the cabinet;
- an induction heating element; and
- a support assembly positioned within the cabinet adjacent the drum, the support assembly comprising
  - a plate movable along a radial direction relative to the drum, the induction heating element positioned on the plate;
  - a bearing mounted to the plate, the bearing contacting the drum as the drum rotates about the axis such that the bearing spaces the plate from the drum along a radial direction that is perpendicular to the axis; and
  - a spring coupled to the plate, the plate movable along the radial direction relative to the drum on the spring, the spring urging the plate towards the drum along the radial direction such that the bearing contacts the drum as the drum rotates about the axis.

2. The induction dryer appliance of claim 1, wherein the support assembly further comprises a pair of springs coupled to the plate, the pair of springs urging the plate towards the drum such that the bearing contacts the drum as the drum rotates about the axis, the springs of the pair of springs spaced apart along an axial direction that is parallel to the axis.

3. The induction dryer appliance of claim 1, wherein the bearing contacts the drum to maintain a constant gap between the induction heating element and the drum along the radial direction as the drum rotates about the axis.

4. The induction dryer appliance of claim 1, wherein the bearing is a first bearing, the support assembly further comprising a second bearing spaced from the first bearing along an axial direction that is parallel to the axis.

5. The induction dryer appliance of claim 1, wherein the bearing is a roller bearing.

6. The induction dryer appliance of claim 1, wherein the drum comprises a ferromagnetic material, and the induction heating element is operable to heat the drum by inducing eddy currents in the ferromagnetic material.

7. The induction dryer appliance of claim 1, wherein the induction heating element is positioned below the drum on the plate.

8. The induction dryer appliance of claim 1, further comprising a motor and a belt, the belt coupled to the motor and the drum such that the motor is operable to rotate the drum about the axis with the belt.

9. The induction dryer appliance of claim 8, further comprising an additional induction heating element and an additional support assembly, the additional induction heating element positioned on a plate of the additional support assembly, the induction heating element positioned opposite the additional induction heating element about the belt along an axial direction that is parallel to the axis.

10. An induction dryer appliance, comprising:
- a cabinet;
- a drum positioned within the cabinet, the drum rotatable about an axis within the cabinet;
- a motor;
- a belt coupled to the motor and the drum such that the motor is operable to rotate the drum about the axis with the belt;
- a pair of induction heating elements, one of the pair of induction heating elements positioned opposite the other of the pair of induction heating elements about the belt along an axial direction that is parallel to the axis; and
- a pair of support assemblies positioned within the cabinet adjacent the drum, each support assembly of the pair of support assemblies comprising a plate and a bearing,
- wherein each induction heating element of the pair of induction heating elements is positioned on a respective plate of the pair of support assemblies, and
- wherein each bearing is mounted to a respective plate of the pair of support assemblies, each bearing contacting the drum as the drum rotates about the axis in order to space the respective plate from the drum along a radial direction that is perpendicular to the axis.

11. The induction dryer appliance of claim 10, wherein each support assembly of the pair of support assemblies further comprises a spring coupled to the respective plate of the pair of support assemblies, the spring urging the respective plate of the pair of support assemblies towards the drum such that each bearing contacts the drum as the drum rotates about the axis.

12. The induction dryer appliance of claim 10, wherein each support assembly of the pair of support assemblies further comprises a pair of springs coupled to the respective plate of the pair of support assemblies, each pair of springs urging the respective plate of the pair of support assemblies towards the drum such that each bearing contacts the drum as the drum rotates about the axis, the springs of each pair of springs spaced apart along an axial direction that is parallel to the axis.

13. The induction dryer appliance of claim 10, wherein each bearing contacts the drum to maintain a constant gap between the pair of induction heating elements and the drum along the radial direction as the drum rotates about the axis.

14. The induction dryer appliance of claim 10, wherein each support assembly of the pair of support assemblies comprises a pair of bearings, the bearings of each of the pair of bearings spaced along an axial direction that is parallel to the axis.

15. The induction dryer appliance of claim 10, wherein each bearing is a roller bearing.

16. The induction dryer appliance of claim 10, wherein the drum comprises a ferromagnetic material, and the pair of induction heating elements are operable to heat the drum by inducing eddy currents in the ferromagnetic material.

17. The induction dryer appliance of claim 10, wherein the pair of induction heating elements are positioned below the drum.

* * * * *